United States Patent [19]

Larue et al.

[11] Patent Number: 4,822,948

[45] Date of Patent: Apr. 18, 1989

[54] SELF-COOLED PROCESS FOR EXTRACTING HEAVY HYDROCARBON FRACTIONS

[75] Inventors: Joseph Larue, Chambourcy; Alexandre Rojey, Garches, both of France

[73] Assignee: Institut Francais du Petrole, Rueil-Malmaison, France

[21] Appl. No.: 56,343

[22] Filed: May 27, 1987

Related U.S. Application Data

[63] Continuation of Ser. No. 810,127, Dec. 18, 1985, abandoned.

[30] Foreign Application Priority Data

Dec. 18, 1984 [FR] France ..... 84 19500

[51] Int. Cl.[4] ..... C07C 5/48; C07C 7/10; C07C 7/00

[52] U.S. Cl. ..... 585/834; 585/864; 585/866; 585/867; 585/833

[58] Field of Search ..... 585/864, 866, 867, 833, 585/834

[56] References Cited

U.S. PATENT DOCUMENTS

| | | | |
|---|---|---|---|
| 2,762,453 | 9/1956 | Alexander | 585/864 |
| 2,794,516 | 6/1957 | Baggett | 585/866 |
| 3,098,107 | 7/1963 | Becker | 585/864 |
| 3,943,185 | 3/1976 | Tschopp | 585/864 |
| 4,334,102 | 6/1982 | Decker et al. | 585/833 |

*Primary Examiner*—H. M. S. Sneed
*Assistant Examiner*—Chung K. Pak
*Attorney, Agent, or Firm*—Millen & White

[57] ABSTRACT

This new process provides for the treatment of a gas containing a light fraction and a heavy fraction, so as to extract at least a portion of the heavy fraction.

The process is characterized in that the gas to be treated (1) is contacted with a solvent (8) under cooling conditions to selectively absorb at least a portion of the heavy fraction of the gas in the solvent; the light unabsorbed fraction is discharged (16) and the solution of the heavy fraction in the solvent (18) is subjected to desorption ($B_1$): the solvent (6) is recycled and the evaporated heavy fraction (9) is condensed (C), expanded ($V_1$) and evaporated in thermal exchange contact ($E_2$) with the mixture of the gas and the solvent to be cooled; the heavy fraction is discharged (14).

The process may be used for the treatment of gas on the field (associated gas, natural gas) and/or in refining and petrochemical operations.

11 Claims, 1 Drawing Sheet

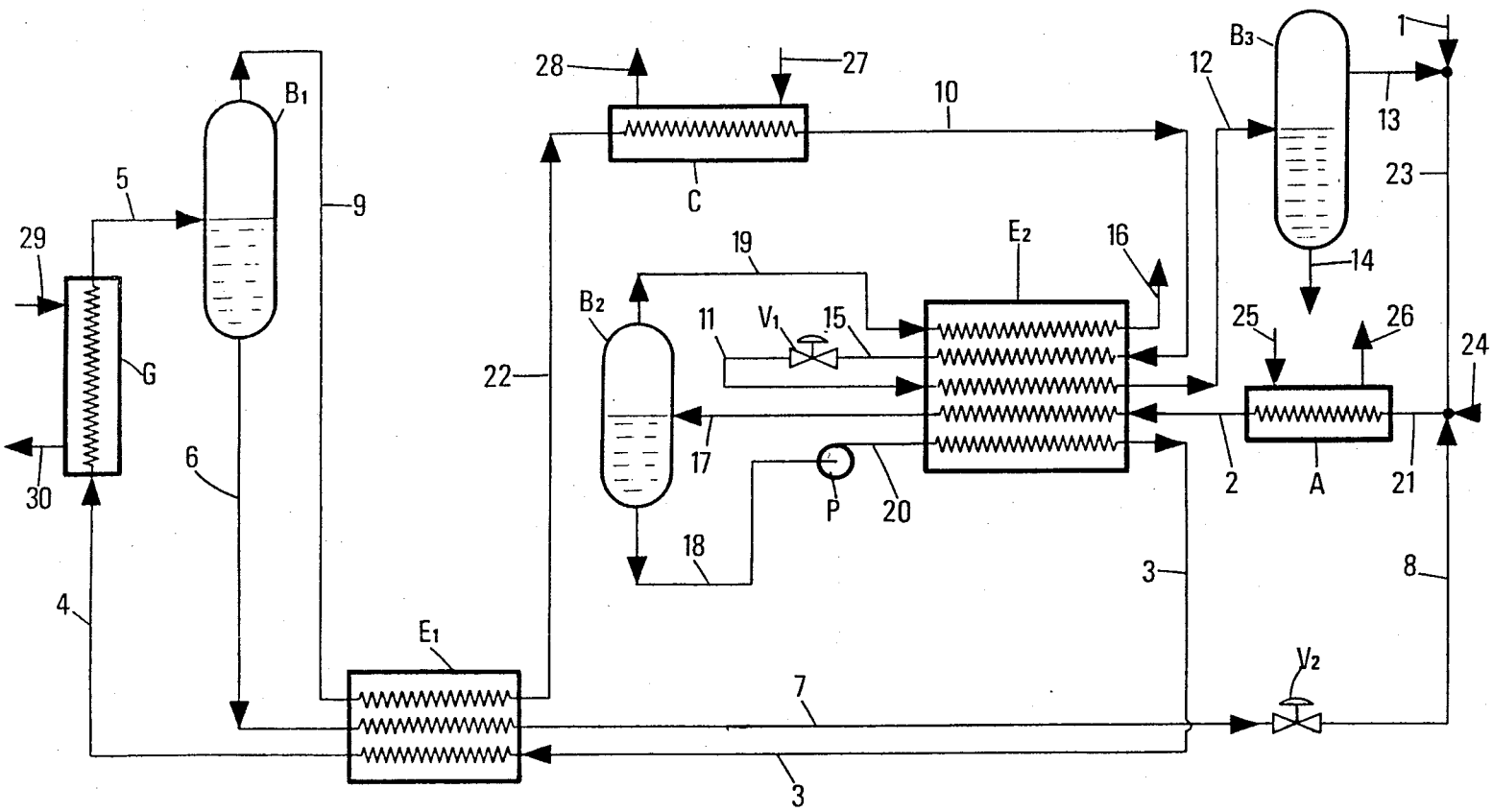
1
13
23
24
26
14
21
8
A
B3
12
25
2
V2
3
16
E2
10
20
27
15
P
7
3
V1
19
11
17
18
C
B2
28
22
E1
9
B1
6
5
G
4
29
30

SELF-COOLED PROCESS FOR EXTRACTING HEAVY HYDROCARBON FRACTIONS

This application is a continuation of application Ser. No. 810,127, filed Dec. 18, 1985, now abandoned.

This invention concerns a new self-cooled process basically operating on the principle of absorption-desorption in a solvent and providing for the extraction of hydrocarbons having a number of carbon atoms of at least 2, e.g. 2 to 6, from a gas containing the same. This process may be used for treating gas in the field when the gas to be treated is, for example, a natural gas or an associated gas, and/or in refining and petrochemical operations.

BACKGROUND OF THE INVENTION

When a gas, for example a petroleum gas, contains a large proportion of heavy components, i.e. of easily condensable hydrocarbons, and when this gas has to be transported, it is necessary to free it of a portion of its components in order to avoid the formation of liquid plugs which would otherwise disrupt the transportation of the gas.

On the other hand, the recovered products may be of economic interest.

The most widely used processes for achieving such separations are of three types: expansion, absorption in a solvent and cooling.

Expansion of the gas is the simplest process; it has the disadvantage of substantially decreasing the gas pressure and leads to a low recovery yield.

In the absorption processes, the gas is contacted with the solvent wherein the heavier constituents of the gas are preferentially absorbed; the solvent having an increased content in these constituents is then subjected to expansion and/or heating so as to be regenerated and rto release the absorbed constituents; certain steps of these processes, particularly the absorption and the recovery of heavy fractions, may be refrigerated by an external refrigerating cycle.

The most conventional process consists of cooling the gas by means of an external refrigerating unit; it can be performed within a wide temperature and pressure range and leads to high recovery.

The present process is particularly adapted to the treatment of a gas containing a light fraction and a heavy fraction, wherein the light fraction contains at least one light constituent from the group comprising hydrogen, nitrogen and hydrocarbons of 1 to 2 carbon atoms and the heavy fraction contains at least one heavy constituent from the group comprising hydrocarbons of 2 to 6 carbon atoms, provided that, when the light fraction contains one hydrocarbon of 2 carbon atoms, the heavy fraction contains at least one hydrocarbon having 3 to 6 carbon atoms.

SUMMARY OF THE INVENTION

The process according to the invention comprises the treatment of a gas such as above-defined by extraction in a liquid phase solvent, so selected that the solubility of the heavy fraction in the solvent is higher than that of the light fraction, the liquid phase solvent being substantially undistillable under the process operating conditions. It is characterized by the steps of:

(a) Contacting the gas with the solvent liquid phase so as to absorb to a major extent at least a portion of the heavy fraction of the gas in the liquid phase and to decrease to a major extent the heavy fraction content of said gas, the resultant evolved heat being released transferred to at least one other fluid by indirect heat exchange, (b) fractionating the product of step (a) so as to separately recover the resultant liquid phase and the unabsorbed gas, (c) increasing the pressure of the liquid phase separated in step (b) and sufficiently increasing its temperature to desorb therefrom at least a part of the gas absorbed therein in step (a), (d) fractionating the product of step (c), to separately recover a lean solution and a desorbed gas phase, (e) cooling the lean solution decreasing its pressure and feeding it back to step (a) so as to reconstitute at least a portion of the solvent liquid phase, (f) cooling the desorbed gas phase so as to condense at least a part thereof and recovering the resultant condensate, (g) expanding the condensate and heating the expanded condensate so as to evaporate at least a portion thereof and recovering the product resulting from said at least partial evaporation, of increased content of heavy constituent as compared to the initial gas, said process being further characterized in that at least a portion of the heat transferred in step (a) is transferred to the expanded condensate in step (g).

Undistillable means that the major part and preferably at least 90%, more often 98%, of the liquid phase is not vaporized under the operating conditions of the process. By absorption to a major extent (or selective absorption) of the heavy fraction, it is meant that the relative proportion of absorbed heavy fraction is higher than the relative proportion of absorbed light fraction. The decrease to a major extent of the heavy fraction content of the gas means that the relative decrease of the heavy fraction content of the gas is higher than the relative decrease of the light fraction content of the gas.

In the process, the condensate in step (g) may be supplied with heat not only from the absorption step (step a) but also from the condensation step (step f) and from the circulating fluids, the solution of decreased content of heavy fraction from step (e) and separated gas from step (b).

Preferably, the heat released from absorption step (step a) is indirectly transferred in two stages: indirect heat exchange is conducted between the mixture of gas and liquid phase, and, first an external medium and then the condensate of step (g).

Similarly, it is preferable to conduct the condensation step (f) in two stages, first by indirect heat exchange with an external medium and then with the condensate expanded in step (g), the latter step also serving to subcool the condensate if already completely condensed by the external fluid.

According to the degree of evaporation in step (g), the desorbed heavy fraction may be entirely vaporized or only partly vaporized, the vaporization temperature ranging from +10° C. to −50° C. When partly vaporized, a liquid/vapor fractionation will give a condensate, for example butane, and the remaining gas fraction may be either recovered or recycled to be again treated in admixture with fresh gas. In the process according to the invention, at least one of steps (a) and/or (f) may advantageously be conducted at least partially at a temperature lower than room temperature by absorbing heat in step (g).

BRIEF DESCRIPTION OF THE DRAWING

The accompanying drawing represents a flow-sheet illustrating an example of embodiment of the process according to the invention.

The gas to be treated, called rich gas (RG) is fed through line 1 and admixed with a gas flowing from line 13; the total gas stream, flowing through line 23, is contacted with a solvent phase from line 8 and a solvent additional amount from line 24. The mixture circulating through line 21 enters exchanger A wherethrough it is cooled by indirect heat exchange with an external fluid fed through line 25 and discharged through line 26. During this heat exchange, a portion of the heavier constituents of the gas is absorbed in the solvent. The mixture is conveyed from exchanger A through line 2 to heat exchanger $E_2$ wherein it is cooled. Another fraction of the heavier constituents of the gas is absorbed in the solvent; the mixture flows out from exchanger $E_2$ through line 17 and enters drum $B_2$ wherein gas and liquid are separated; the gas, of decreased content of heavy constituents, called lean gas (LG) flows out from drum $B_2$ through line 19, passes through exchanger $E_2$ wherein it is heated by indirect heat exchange and is discharged from the process unit through line 16. The liquid phase, called rich solution (RS), consisting of solvent and absorbed heavy constituents, flows out from drum $B_2$ through line 18, passes through pump P wherein its pressure is increased, enters through line 20 into exchanger $E_2$ wherein it is heated by indirect heat exchange, is conveyed through line 3 to exchanger $E_1$ wherein it is heaed by indirect heat exchange, flows out therefrom through line 4, enters exchanger G wherein it is heated by indirect heat exchange with a hot external fluid fed to exchanger G through line 29 and discharged through line 30. The mixture flows out from exchanger G through line 5 in a partially vaporized state; the liquid phase is separated from the vapor phase in drum $B_1$. The liquid phase, consisting essentially of solvent, called lean solution (LS), flows out from drum $B_1$ through line 6, enters exchanger $E_1$ wherein it is cooled by indirect heat exchange, is conveyed through line 7, passes through valve $V_2$ where its pressure is decreased and is fed to line 8 in order to be again contacted with the gas. The vapor phase (LPG) mainly consisting of the constituents absorbed by the solvent, flows out from drum $B_1$ through line 9, enters exchanger $E_1$ wherein it is cooled by indirect heat exchange, is conveyed through line 22 to condenser C wherein it is cooled by indirect heat exchange with a cold external fluid fed through line 27 and discharged through line 28, at least a partial condensation occurring during said cooling step. The at least partially condensed fluid flows out from exchanger C through line 10, enters exchanger $E_2$, wherein it is cooled, thus giving rise to a total condensation and/or a subcooling, passes through line 15, is expanded through valve $V_1$, is fed through line 11, into exchanger $E_2$ wherein it partially vaporizes by indirect heat exchange, thus absorbing heat, is conveyed through line 12, in a partially vaporized state, to drum $B_3$ wherein the two phases of liquid and vapor are separated. The liquid phase, containing the heavy constituents extracted from the treated gas, is discharged from the process unit through line 14 and the vapor phase is discharged from drum $B_3$ through line 13 and admixed with the gas to be treated, fed through line 1. In this example of an embodiment of the process according to the invention, the absorption of the heavy constituents of the treated gas in the solvent is achieved partially at low temperature; conversely, the condensation of the desorbed heavy fractions may be completely achieved at a temperature close to room temperature, i.e. the outflow from exchanger C passing through line 10 may be completely in the liquid state when the pressure in said zone of the process is sufficiently high.

The rich gas to be treated by the process according to the invention is a petroleum gas which may originate from a producing field (natural gas or associated gas) or may be a gas from a refinery or from a petrochemical unit. This gas may contain saturated or unsaturated, straight-chain, branched or cyclic hydrocarbons such for example as methane, ethane, propane, butane, pentane, hexane, ethylene, propylene, butene, acetylene. Heavier constituents may be present, for example heptane, octane, nonane and decane. The hydrocarbon proportion is the lower as its number of carbon atoms is higher. By the process according to the invention, at least a portion of the hydrocarbons other than methane can be recovered. The gas may also contain a few constituents which form no part of the hydrocarbon family and which are not recovered by thge process, such, for example, as hydrogen, nitrogen, carbon dioxide, hydrogen sulfide, water.

The solvent used in the process according to the invention is so selected as to absorb the heavy constituents of the gas; it is preferably characterized by a boiling point at least 50° C. higher and preferably at least 100° C. higher than that of the heaviest constituent of the heavy fraction of the gas; it may consist of a pure substance or of a mixture. It may be selected from hydrocarbons whose number of carbon atoms is at least equal to 6 and which may be paraffinic, aromatic or naphthenic and may be selected, for example, from oils. One or more hydrogen atoms may be substituted with other atoms such as F, Cl, Br and the solvent may comprise alcohol, aldehyde, ketone, ester, ether, carboxylic acid groups complying in particular with the formulas $R—CH_2—OH$, $R—CHOH—R'$, $RR'R''C—OH$, $R—CHO$, $RR'C{=}O$, $R—COO—R'$, $R—O—R'$, $R—COOH$, wherein R, R' and R'' are hydrocarbon radicals which may be themselves partially substituted.

In the process according to the invention, the external cooling fluid circulating through exchangers A and C may be water, the surrounding air or a fluid supplied from a refrigerating unit external to the process unit.

In the process according to the invention, some exchangers may contain several streams: 3 for $E_1$, 5 for $E_2$ but it is also possible to proceed with heat exchangers between fluids two by two.

The process according to the invention may be used to treat gases at a pressure preferably ranging from 0.1 to 20 MPa. The pressure in steps a, b and g is preferably within the same range as in steps c, d and f and preferably from 0.2 to 20 MPa, with the additional condition that the pressure in steps c, d and f must be at least 0.1 MPa higher and preferably at least 0.5 MPa higher than that of steps a, b and g.

In step e the cooling may precede or follow the pressure decrease: the pressure then changes from the pressure value of step (d) to that of step (a).

The heat indirectly transferred to the process in exchanger G, to achieve the desorption of the absorbed constituents, is at a temperature level preferably ranging from 100° to 300° C.

During vaporization of a part of the absorbed constituents, heat is with drawn from the mixture of solvent and a part of the heavy constituents of the rich gas. The temperature is at a level of vaporization preferably ranging from 10° to −50° C. thereby lowering the temperature of step (a) to preferably below room temperature.

EXAMPLE

The process according to the invention is illustrated by the following example, conducted in accordance with the diagram of the figure of the accompanying drawing.

The gas to be treated, called rich gas, enters the process unit through line 1; its composition is given in table I; its temperature is 35° C., its pressure 0.15 MPa absolute, its flow rate is 1184 Kg/h. It is admixed with the gas supplied through line 13 at a flow rate of 1264 kg/h and with the solvent from line 8 flowing at a rate of 6650 kg/h. An additional solvent amount is introduced through line 24 at a rate of 27 kg/h. The solvent is a paraffinic oil whose normal boiling temperature ranges from 300° to 350° C.

TABLE I

| Constituents | Rich gas kg/h | Lean gas kg/h | Extracted Constituents kg/h |
|---|---|---|---|
| Methane | 193 | 193 | 0 |
| Ethane | 120 | 119 | 1 |
| Propane | 321 | 313 | 8 |
| Butane | 251 | 199 | 52 |
| Pentane | 140 | 44 | 96 |
| Hexane and higher alkanes | 159 | 4 | 155 |

The gas-solvent mixture passes through exchanger A which is cooled by cooling water; at the outlet from exchanger A the mixture is at a temperature of 35° C. It enters exchanger $E_2$ wherein it is cooled down to a temperature of −10° C. The two liquid and vapor phases are separated in drum $B_2$; the gas which has not been absorbed, called lean gas, whose composition is given in table I, flows out from drum $B_2$ through line 19, passes through exchanger $E_2$ and is discharged from the process unit, at a temperature of 30° C., through line 16, at a flow rate of 872 kg/h. The solvent phase of increased content of adsorbed constituents, called rich solution, flows out from drum $B_2$ through line 18, passes through pump P where its pressure is increased up to 0.74 MPa; enters exchanger $E_2$ wherein it is indirectly heated and is conveyed through line 3, to exchanger $E_1$ wherein it is indirectly heated and wherefrom it flows out through line 4, enters exchanger G wherein it is heated by indirect heat exchange with a hot external fluid and flows out through line 5 at a temperature of 200° C. in a partially vaporized state. The two phases of liquid and vapor are separated in drum $B_1$. The liquid phase, of high solvent content, called lean solution, flows out from drum $B_1$ through line 6, passes through exchanger $E_1$ wherein it is cooled, and through line 7 and valve $V_2$ where its pressure is decreased to a value substantially equal to that of the rich gas at the input of the process unit, and then passes through line 8 to be again contacted with the gas to be treated. The gas phase from drum $B_1$ flows out through line 9, through exchanger $E_1$ where it is cooled, through line 22 and enters condenser C where it is cooled down to 35° C. by indirect heat exchange with cooling water. At the output of condenser C, the fluid is completely condensed; it enters exchanger $E_2$ wherein it is sub-cooled, down to −11° C., is expanded through valve $V_1$ to about 0.15 MPa, partially vaporized in exchanger $E_1$ while absorbing heat, conveyed, through line 12 at a temperature of 30° C., to drum $B_3$ wherein the two phases of liquid and vapor are separated; the liquid phase, consisting mainly of constituents extracted from the rich gas, is discharged from the process unit through line 14, its composition is given in Table I. The vapor phase from drum $B_3$ flows out through line 13 and is admixed with the rich gas.

What is claimed as the invention is:

1. In a process for treating a gas containing a light fraction and a heavy fraction, in order to recover at least a portion of the heavy fraction in the liquid phase, the light fraction containing at least one light hydrocarbon having 1 or 2 carbon atoms and the heavy fraction containing at least one heavy hydrocarbon having 2 to 6 carbon atoms, provided that, when the light fraction contains a hydrocarbon of 2 carbon atoms, the heavy fraction contains at least one hydrocarbon having from 3 to 6 carbon atoms, said process involving an extraction in a solvent liquid phase so selected that the solubility of the heavy fraction in the solvent is higher than that of the light fraction, and that the solvent liquid phase is substantially undistillable under the operating conditions of the process, the improvement comprising:

(a) contacting the gas with the solvent liquid phase, at least part of said contacting taking place at a temperature below room temperature, so as to selectively absorb at least a portion of the heavy fraction of the gas into said solvent liquid phase and to selectively decrease the heavy fraction content of the gas, and transferring heat from resultant mixture of gas and solvent to at least the expanded condensate of step (g) by indirect heat exchange, (b) phase separating resultant mixture from step (a) to separately recover unabsorbed gas and resultant solvent liquid phase having selectively absorbed said at least a portion of the heavy fraction of the gas, (c) increasing the pressure of the solvent liquid phase separated in step (b) and sufficiently increasing its temperature to desorb at least a portion of said at least a portion of the heavy fraction of the gas absorbed therein in step (a), (d) phase separating resultant mixture from step (c) to separately recover a lean solution and a desorbed gas phase, (e) cooling said lean solution, decreasing its pressure and feeding it back to step (a) to reconstitute at least a portion of the solvent liquid phase, (f) cooling the desorbed gas phase so as to condense at least a portion thereof, (g) expanding the condensate and transferring heat from the mixture of step (a) to the resulting expanded condensate indirectly so as to evaporate a portion thereof at a temperature of −50° C. to +10° C. and recover a heavy unevaporated liquid phase and a light evaporated gas phase and (h) recovering said heavy unevaporated liquid phase.

2. A process according to claim 1, wherein a portion of the heat from the mixture of step (a) is transferred to an external cooling fluid prior to indirect heat exchange with the expanded condensate in step (g).

3. A process according to claim 1, characterized in that said light gas phase is fed back to step (a) to be contacted again with the solvent liquid phase.

4. A process according to claim 1, wherein the solvent is a paraffinic, or naphthenic hydrocarbon of at least 6 carbon atoms, an aromatic hydrocarbon, a haloenated hydrocarbon, an alcohol of formula R—$CH_2$—OH, R—CHOH—R', or RR'R''C—OH, an aldehyde of formula R—CHO, a ketone of formula RR'C=O, an ester of formula R—COO—R', an ether of formula R—O—R', an organic acid of formula R—COOH, or a mixture thereof, R, R' and R'' being substituted or unsubstituted hydrocarbon radicals.

5. A process according to claim 1, characterized in that the pressure in steps a, b and g ranges from 0.1 to 20 MPa and the pressure in steps c, d and f ranges from 0.2 to 20 MPa, with the additional condition that the pressure in steps c, d and f is at least 0.1 MPa higher than that of steps a, b and g.

6. A process according to claim 1, characterized in that the temperature in step (c) ranges from 100° to 300° C.

7. A process according to claim 1, wherein the gas to be treated is natural gas or a petroleum gas originating from a refinery or a petrochemical unit.

8. A process according to claim 1, wherein said expanded condensate in step (g) is further indirectly heated with the condensing fluid of step (f).

9. A process according to claim 1, wherein the condensation step (f) is carried out in two stages, first by indirect heat exchange with an external heat exchange medium and then with the condensate expanded in step (g).

10. A process according to claim 1, wherein the solvent possesses a boiling point of at least 50° C. higher than that of the heaviest constituent of the heavy fraction of the gas.

11. A process according to claim 1, wherein the resultant mixture from step (a) is at least as cold as about −10° C.

* * * * *